US007007864B2

(12) United States Patent
Snyder et al.

(10) Patent No.: US 7,007,864 B2
(45) Date of Patent: Mar. 7, 2006

(54) FUEL NOZZLE DESIGN

(75) Inventors: Timothy S. Snyder, Glastonbury, CT (US); James B. Hoke, Tolland, CT (US)

(73) Assignee: United Technologies Corporation, Hartford, CT (US)

( * ) Notice: Subject to any disclaimer, the term of this patent is extended or adjusted under 35 U.S.C. 154(b) by 114 days.

(21) Appl. No.: 10/291,950

(22) Filed: Nov. 8, 2002

(65) Prior Publication Data

US 2004/0089747 A1 May 13, 2004

(51) Int. Cl.
*B05B 1/28* (2006.01)

(52) U.S. Cl. ..... 239/105; 239/112; 239/132; 239/132.5; 239/290; 239/291; 239/400; 239/406; 239/533.2; 60/740; 60/742

(58) Field of Classification Search ..... 239/132, 239/132.3, 132.5, 533.2, 533.3, 533.9, 533.11, 239/533.12, 104, 105, 112, 290, 291, 400, 239/403, 405, 406; 60/737, 740, 742, 748
See application file for complete search history.

(56) References Cited

U.S. PATENT DOCUMENTS

| | | | | | |
|---|---|---|---|---|---|
| 2,774,629 | A | * | 12/1956 | Noon et al. | 239/105 |
| 3,630,024 | A | * | 12/1971 | Hopkins | |
| 4,726,761 | A | * | 2/1988 | Binasik et al. | 239/405 |
| 4,798,330 | A | * | 1/1989 | Mancini et al. | 239/290 |
| 4,977,740 | A | * | 12/1990 | Madden et al. | 60/742 |
| 5,288,021 | A | * | 2/1994 | Sood et al. | |
| 5,400,968 | A | * | 3/1995 | Sood | |
| 5,467,926 | A | * | 11/1995 | Idleman et al. | 239/406 |
| 6,082,113 | A | * | 7/2000 | Prociw et al. | |
| 6,189,814 | B1 | * | 2/2001 | Richards | 239/434 |
| 6,718,770 | B1 | * | 4/2004 | Laing et al. | 60/740 |

* cited by examiner

*Primary Examiner*—Steven J. Ganey
(74) *Attorney, Agent, or Firm*—Bachman & LaPointe, P.C.

(57) ABSTRACT

The present invention relates to a fuel nozzle for use in an engine such as a gas turbine engine. The fuel nozzle includes a fuel injector for injecting fuel into a combustion chamber of the engine and a plurality of rows of holes surrounding the fuel injector for eliminating recirculation of hot gas products onto a face of the fuel nozzle. The holes eject air primarily in an axial direction.

11 Claims, 2 Drawing Sheets

FUEL NOZZLE DESIGN

BACKGROUND OF THE INVENTION

Figure 1:
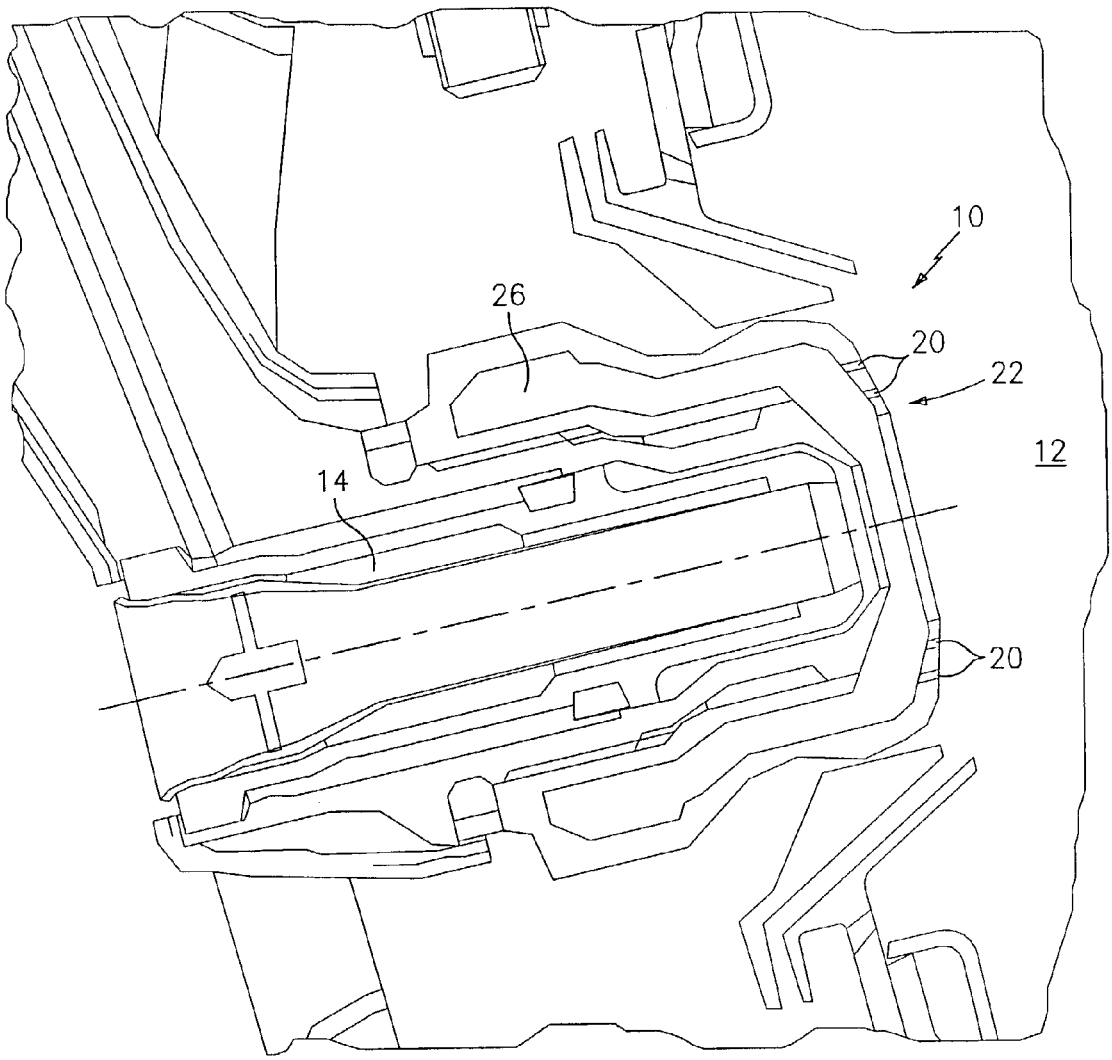

The present invention relates to a fuel nozzle design for use in a gas turbine engine which significantly extends the life of a fuel nozzle by preventing hot gases from recirculating on the nozzle surface while not adversely affecting the ignition or low emissions capability of the fuel nozzle.

Fuel nozzles can have a shortened life span as a result of hot gases recirculating on the nozzle surface. Such hot gases have the opportunity of being recirculated back to the face of the fuel nozzle because of the recirculation set up between the guide swirler and the inner and outer fuel nozzle swirler. Such fuel nozzles are undesirable because they lead to increased engine maintenance costs and undesirable engine down time to replace the fuel nozzles.

Thus, fuel nozzles having extended life spans are quite desirable.

SUMMARY OF THE INVENTION

Accordingly, it is an object of the present invention to provide a fuel nozzle which has a significantly extended life.

It is a further object of the present invention to provide a fuel nozzle as above which prevents hot gases from recirculating on a nozzle surface.

The foregoing objects are obtained by the fuel nozzle of the present invention.

In accordance with the present invention, a fuel nozzle for use in an engine broadly comprises means for injecting fuel into a combustion chamber of said engine and means surrounding the fuel injecting means for eliminating recirculation of hot gases onto a face of the fuel nozzle. In a preferred embodiment of the present invention, the hot gas recirculation eliminating means comprises a plurality of rows of holes for ejecting air primarily in an axial direction, with the holes in adjacent rows being offset from each other. Each of the rows of holes has an annular arrangement of the holes.

Other details of the fuel nozzle design of the present invention, as well as other objects and advantages attendant thereto, are set forth in the following detailed description and the accompanying drawings wherein like reference numerals depict like elements.

BRIEF DESCRIPTION OF THE DRAWING(S)

Figure 2:
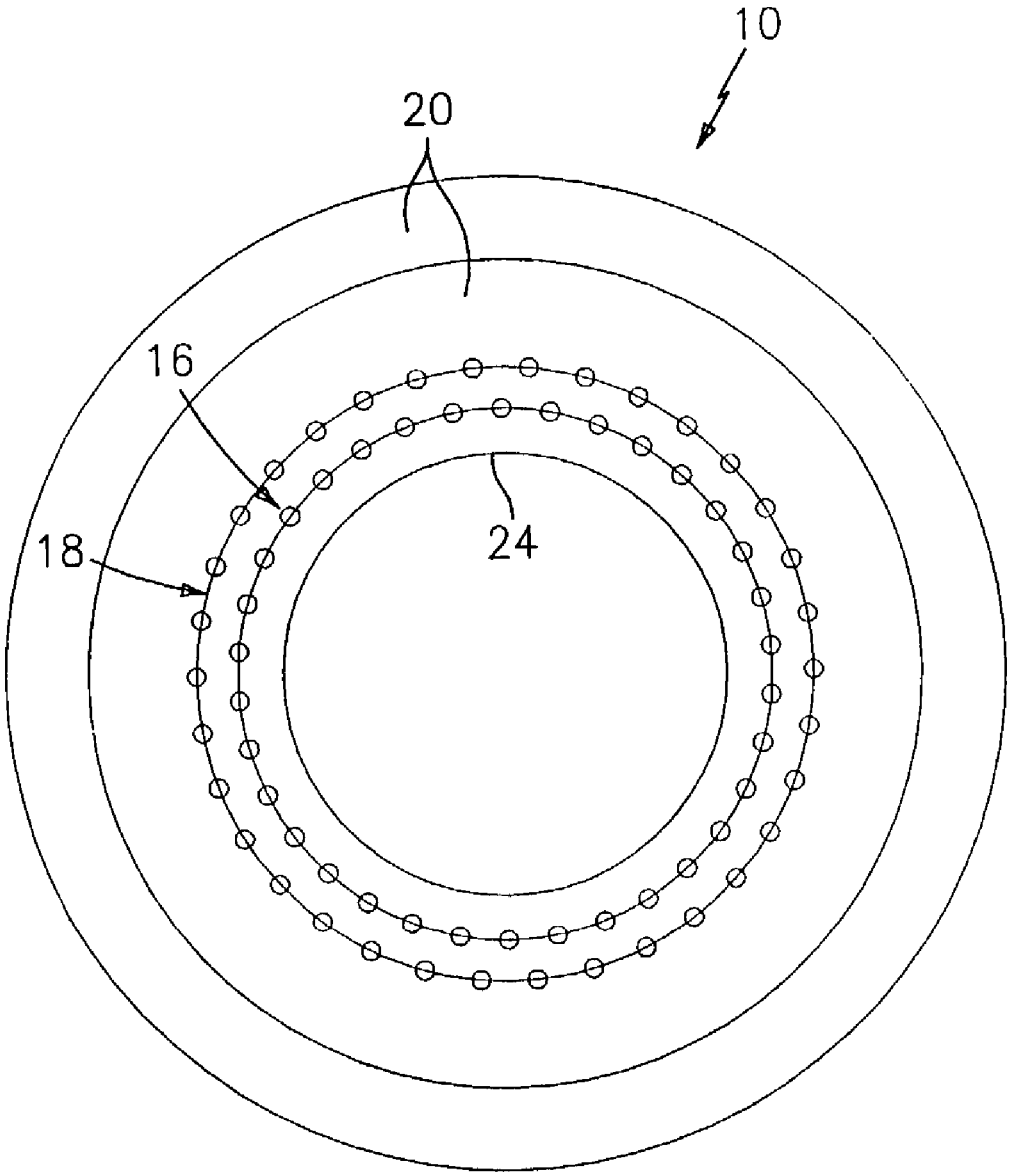

FIG. 1 is a side view of a fuel nozzle for injecting fuel into a combustion chamber of a gas turbine engine; and FIG. 2 is a front view of a fuel nozzle in accordance with the present invention.

DETAILED DESCRIPTION OF THE PREFERRED EMBODIMENT(S)

Referring now to the drawings, FIG. 1 illustrates a fuel nozzle 10 for injecting a fuel and air mixture into a combustion chamber 12 of an engine such as a gas turbine engine. The fuel nozzle 10 includes a fuel injector 14. A plurality of rows 16 and 18 of holes 20 are provided for injecting air into the combustion chamber 12.

As shown in FIG. 2, the rows 16 and 18 each have a plurality of holes 20 arrayed in an annular, concentric arrangement with the holes 20 in one row being offset with respect to the holes 20 in the adjacent row. Each of the holes

20 has the same diameter and is equally spaced from its adjacent holes. In order to eliminate hot products such as hot gases from recirculating onto a face 22 of the fuel nozzle 10, the holes 20 preferably are spaced apart a distance within the range of 1.5 to 3.0 times the diameter of each hole 20. Further, the rows 16 and 18 preferably are spaced apart by a distance which is within the range of 1.5 to 3.0 times the diameter of each hole 20. Still further, the innermost row 16 is preferably spaced from an inner lip 24 of the fuel nozzle 10 by a distance which is within the range of 1.5 to 3.0 times the diameter of each hole 20. The number of holes in the overall nozzle should be sufficient in area to have an impact on the flow field and eliminate any recirculation zone. In a preferred embodiment of the present invention, there are 34 holes in each of the rows 16 and 18.

As mentioned before, each of the holes 20 is used to inject air into the combustion chamber 12. Each of the holes 20 receives air from an outer swirler 26 at a velocity sufficient to eliminate the recirculation. A suitable velocity is within the range of 190 ft/sec to 440 ft/sec, preferably 265 ft/sec to 365 ft/sec, and most preferably 315 ft/sec. In operation, the air flowing through each of the holes 20 is primarily axial in direction. As used herein, the phrase "primarily axial in direction" means that the flow is more axial than radial.

Ignition tests conducted at atmospheric pressure in a 4 nozzle box rig showed no adverse affects of the holes on lighting or lean blowout.

It is apparent that there has been provided in accordance with the present invention a fuel nozzle design which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A fuel nozzle for use in an engine comprising:

means for injecting fuel into a combustion chamber of said engine;

means surrounding said fuel injecting means for eliminating recirculation of hot gases onto a face of said fuel nozzle, said recirculation eliminating means comprising a plurality of rows of holes wherein each of said holes is provided with a flow of air at a velocity sufficient to prevent said recirculation;

wherein said holes eject air primarily in an axial direction, each of said rows having an annular arrangement of said holes;

each of said rows including a plurality of holes;

each of said holes having the same diameter; and each of said holes being spaced apart a distance in the range of between 1.5 and 3.0 diameters.

2. A fuel nozzle according to claim 1, further comprising said rows being spaced apart a distance within the range of 1.5 to 3.0 diameters.

3. A fuel nozzle according to claim 1, further comprising:

an inner lip; and an inner row of said row of holes being spaced a distance from the inner lip within the range of 1.5 to 3.0 diameters.

4. A fuel nozzle according to claim 1, wherein said velocity is in the range of from 190 ft/sec to 440 ft/sec.

5. A fuel nozzle according to claim 1, wherein said velocity is in the range of from 265 ft/sec to 365 ft/sec.

6. A fuel nozzle according to claim 1, wherein said nozzle has an outer swirler and each of said holes receives air from said outer swirler.

7. A fuel nozzle according to claim 1, wherein each of said rows of holes has thirty-four equally spaced holes.

8. A fuel nozzle for use in an engine comprising:

a fuel injector for injecting fuel into a combustor chamber;

a plurality of holes surrounding said fuel injector for generating a primarily axial flow of air sufficient to eliminate recirculation of hot gas products onto a face of said fuel nozzle;

said plurality of holes arranged into two concentric rows of holes; and each of said holes having the same diameter and being spaced from each of its adjacent holes by a distance within the range of 1.5 to 3.0 times said diameter.

9. A fuel nozzle according to claim 8, wherein said rows of holes are spaced apart by a distance within the range of 1.5 to 3.0 times said diameter.

10. A fuel nozzle according to claim 8, wherein said rows of holes includes an inner row and said inner row is spaced from an inner lip by a distance in the range of 1.5 to 3.0 times said diameter.

11. A fuel nozzle according to claim 8, wherein each of said holes is provided with a flow of air at a velocity sufficient to prevent said recirculation.

* * * * *